US011141037B1

(12) United States Patent
Sawyer

(10) Patent No.: US 11,141,037 B1
(45) Date of Patent: Oct. 12, 2021

(54) SCRATCH-RESISTANT MOPS AND METHODS OF MAKING SAME

(71) Applicant: WHIP CORAL CUSTOM MOPS LLC, Houston, TX (US)

(72) Inventor: Billy Drake Sawyer, Port Aransas, TX (US)

(73) Assignee: WHIP CORAL CUSTOM MOPS LLC, Houston, TX (US)

( * ) Notice: Subject to any disclaimer, the term of this patent is extended or adjusted under 35 U.S.C. 154(b) by 327 days.

(21) Appl. No.: 16/374,876

(22) Filed: Apr. 4, 2019

Related U.S. Application Data

(60) Provisional application No. 62/670,076, filed on May 11, 2018.

(51) Int. Cl.
*A47L 13/24* (2006.01)

(52) U.S. Cl.
CPC ..... *A47L 13/24* (2013.01)

(58) Field of Classification Search
CPC ..... A47L 13/20; A47L 13/24; A47L 13/42; A47L 13/44
USPC ..... 15/229.1–229.2, 229.6; 300/21
See application file for complete search history.

(56) References Cited

U.S. PATENT DOCUMENTS 1,406,248 A * 2/1922 Tucker ..... A47L 13/20 15/229.1
1,462,794 A * 7/1923 Kumpunen ..... A47L 13/24 15/228
2,060,621 A * 11/1936 Jayne ..... A47L 13/24 15/229.1
4,114,224 A * 9/1978 Disko ..... A47L 13/20 15/226
5,177,831 A 1/1993 Wirth
5,470,653 A 11/1995 Honeycutt et al.
5,985,443 A 11/1999 Honeycutt et al.
6,783,852 B2 8/2004 Inada et al.
8,375,502 B2 2/2013 Scott et al.

OTHER PUBLICATIONS

"Swobbit Quick Dry Mop", from https://www.amazon.com/Swobbit-Quick-Strips-Part-Sw31215/dp/B01DTMJ5II/, date first available Jun. 14, 2016. (Year: 2016).*

(Continued)

*Primary Examiner* — Laura C Guidotti
(74) *Attorney, Agent, or Firm* — Jeffrey L. Wendt; The Wendt Firm, P.C.

(57) ABSTRACT

A scratch-resistant mop, and methods of making same are presented. The mop has a pole having first and second ends and a rubber end cap secured to the first end of the pole. The mop has strips of absorbent chamois material cut from chamois sheets. The strips from each sheet have a common end margin. The common end margins are wrapped in alternating directions and attached to the end cap using waxed lines wrapped over each of the common end margins and about the base of the end plug. The strips of absorbent chamois material are pulled tightly back over the common end margins and waxed lines so that all the strips may be gathered and secured at a distal end of the end cap with a final waxed line, forming a scratch-resistant "apple" of the absorbent chamois material and free strips of the absorbent chamois material.

19 Claims, 7 Drawing Sheets

(56) References Cited

OTHER PUBLICATIONS

BBM eNews, by Rick Mullen, "Broom, Brush & Mop Magazine" http://www.broombrushandmop.com/news10-18.html, Aug. 2018. (Year: 2018).*

"CleanTools Marine Products and Uses", CleanTools, Westmont Illinois (USA), downloaded from the Internet on May 7, 2018, p. 1-2.

"Shurhold Deluxe Water Sprite Mop", Shurhold Industries, Inc., Palm City Florida (USA), downloaded from the Internet on Feb. 6, 2018, p. 1-3.

* cited by examiner

SCRATCH-RESISTANT MOPS AND METHODS OF MAKING SAME

BACKGROUND INFORMATION

Technical Field

The present disclosure relates to mops and methods of making same. More particularly, the present disclosure relates to scratch-resistant mops including absorbent material attached to a pole or other handle in a unique fashion, and methods of making same, the mops especially useful for marine application, especially for cleaning and drying yachts and similar marine vessels.

Background Art

Yacht owners, and owners or operators of other marine vessels, especially marine vessels designed for pleasure boating, cruising, exploring, and racing, are interested in maintaining their vessels in extraordinary condition. This is especially true for the appearance of such vessels. As used herein, "marine vessels" includes, but is not limited to, vessels that operate in seawater, as well as fresh water-going vessels.

A service exists within the marine industry for the maintenance, cleaning, and drying of marine vessels, especially marine vessel decks, hulls, and other exposed equipment, such as chairs, tables, gaming areas, and the like. Many owners will either do this themselves, or hire out to a service company to perform these tasks. Mops used in this service tend to include natural or synthetic chamois material as the absorbent material, the absorbent material attached to a pole or handle. Known mops employ handles made of metal tube, wood, or plastic. In the case of metal tube handles, the absorbent material is attached to a short piece of tubing that may then be "quick-connected/disconnected" to and from a longer metal tube that is the major portion of the handle. Wood and plastic handles may also include such quick connects. In any case, the absorbent chamois material is connected to the handle using metal wire or other cordage that is prone to corrode easily, forming an oxide surface that easily scratches plastic, wood, and even some metal decks, hulls and other marine equipment when the mop is drawn over the object being cleaned or dried. Even when "new" these wires or cordage may have a surface hardness that is prone to scratching such surfaces.

Moreover, many of the mops in use today employ initially good looking absorbent chamois materials that, however, suffer from poor extended absorbency and/or poor durability. Most marine decks, stairways, walkways, and other surfaces are fitted with, or designed to include, non-slip materials or surfaces. As can be imagined, if the absorbent materials are of inferior quality, after a very short time both their usefulness to mop up fluids and remove water spots, as well as their ragged appearance, may be unsatisfactory to vessel owners and maintenance personnel. Not using the mops to their full capacity may lead to more frequent purchases of replacement mops, in other words, the mops being changed out before they are technically beyond use. The greater concern is personnel now working around areas that are unsafe and using whatever absorbent is available. Shorter life mops means an increase in cost, but more importantly, decreased safety.

Other marine vessels may benefit from extended absorbency and/or more durable mops, including motor yachts, sport-fishing vessels, racing boats, and aircraft such as helicopters. In the car care industry there may be a need for drying personal vehicles, car washes, and possibly larger commercial vehicles that are typically difficult to dry with a hand chamois. The present disclosure is applicable to all such vessels and vehicles.

U.S. Pat. No. 8,375,502 (Scott et al.) describes a mop head for cleaning and drying floors and other surfaces includes a first portion formed of microfiber material and a second portion formed of chamois material. The first portion cleans a surface as it is moved across it and the second portion dries the surface. U.S. Pat. No. 5,177,831 (Wirth) describes a cloth covered sponge mop for cleaning, waxing polishing or drying a motor vehicle which includes a sponge element, a handle with a protective guard, a connecting plate for connecting the sponge element to the handle, and a fabric cover (made of materials such as natural or synthetic sheepskin, terry cloth, or chamois depending on the activity) entirely enclosing the sponge element and the connecting plate. The fabric cover element includes an insertion aperture and a closure element, such as Velcro®, for joining the periphery of the aperture and completely enclosing the sponge element and the connecting plate with non-metallic components. U.S. Pat. Nos. 5,479,653 and 5,985,443 disclose a mop head comprising a bundle of fibers bound together to create mop head fabric. The fibers are composed of polyvinyl alcohol which is water-soluble at temperatures above approximately 93° C. A process of dope extrusion produces the polyvinyl alcohol fibers, which contain wetting and anti-blocking agent. In addition to the above-mentioned patents, there have been issued many patents on kitchen or home floor mops, sometimes referred to as "butterfly mops" with a crank handle for squeezing out water and fluids. Some companies cater to, or sell products made by other companies that cater to the marine industry, including the category of "Boat Maintenance/Boat Cleaning Supplies/Deck Brushes, Handles & Heads." The Internet websites of West Marine and a company known as TD Mops revealed chamois mops such as that known under the trade designation SHURHOLD Synthetic Chamois Mop. Unfortunately, no details are given, either on the absorbent material or the string binding, and the product photograph shows a quick connect/disconnect handle attachment. None of these patents or websites disclose a mop where three or more chamois sheets are secured to a handle by a wax-covered string or other scratch-resistant material, nor are the absorbency or durability of these products discussed. All of these patents, published patent applications, and Internet webpages showing boat maintenance, boat cleaning supplies, deck brushes, handles and heads are incorporated herein by reference for their disclosure of structure, composition, and operation of known mops, and accessories for same, such as handles, hand grips, cleaning fluids, absorbent materials, testing of absorbency and durability, and the like.

Owner and personnel safety is of utmost concern. Yacht owners tend to be very particular, not only about the safety and appearance of their vessels, but the quality of the products they use to maintain their vessels safe and aesthetically pleasing to their guests. Their lives and their livelihoods depend on it. They also tend to be skeptics of any new products that they may feel are not worth switching from a product they are currently using, even if they are replacing those products more frequently than they need to. As noted above, this may result in more than necessary mop purchases, or increased potential for accidents and injury to guests and workers if defective mops are not replaced.

As may be seen, there remains a need for more robust mops for marine cleaning and drying, particularly mops that reduce exposure of owners, guests and personnel to wet, slick surfaces and potential for injury. The mops and methods of making same of the present disclosure are directed to these needs.

SUMMARY

In accordance with the present disclosure, scratch-resistant mops and unique methods of making the same are described which reduce or overcome many of the faults of previously known mops and methods.

A first aspect of the disclosure is a scratch-resistant mop comprising (or consisting of, or consisting essentially of):

a) a pole (preferably hardwood, lacquered or painted; or fiberglass reinforced plastic (FRP)) having first and second ends and an outside diameter (OD);

b) a rubber or rubber-coated end cap having an internal diameter (ID) equal to or slightly less than the pole OD secured to the first end of the pole;

c) a plurality of strips of absorbent chamois material having a common end margin and each having a free end, the common end margin attached to the rubber or rubber-coated end cap using (preferably only) one or more waxed lines wrapped over the common end margin about the base of the rubber or rubber-coated plug; and d) the plurality of strips of absorbent material pulled tightly back over the secured common end margin and waxed lines so that end portions of the common end margins extend past the end cap, and all the strips are gathered and secured at a distal end of the end cap with a final waxed line, forming a scratch-resistant apple of the absorbent chamois material and the free ends.

In certain embodiments the rubber or rubber-coated end cap may be glued to the first end of the pole. In certain embodiments the plurality of strips of absorbent chamois material may be derived from first, second, and third sheets of the absorbent chamois material, each cut lengthwise into strips about 90 percent of their length, each strip having a strip width and forming the plurality of absorbent chamois material strips, the plurality of strips of absorbent chamois material each having a having a respective first, second, and third common end margin. In certain embodiments the respective common end margin of the first, second, and third absorbent chamois material sheets may be wrapped about the rubber or rubber-coated end cap, the common end margin of the first sheet wrapped in a first direction, the common end margin of the second sheet wrapped in a direction opposite the first direction, and the common end margin of the third sheet wrapped in the first direction, and the one or more waxed lines may comprise (or consist of, or consist essentially of) a first waxed line securing the wrapped common end margin of the first sheet, a second waxed line securing the wrapped common end margin of the second sheet, a third waxed line securing the wrapped common end margin of the third sheet, the first, second, and third waxed lines positioned in substantially the same longitudinal position about the base of the rubber or rubber-coated end cap, and a final waxed line securing the gathered strips of absorbent chamois material at a top of the rubber or rubber-coated end cap, the apple of the absorbent chamois material formed between the base and the top of the rubber or rubber-coated end cap.

In certain embodiments, each of the plurality of strips of absorbent chamois material may comprise (or consist of, or consist essentially of) polyvinyl alcohol. In certain embodiments the pole may be a lacquered or painted hardwood. In certain embodiments the rubber of the rubber end cap may be selected from EPM (copolymer of ethylene and propylene), EPDM (terpolymer of ethylene, propylene, and diene monomer), vinyl rubber, PVC (polyvinyl chloride), NBR (nitrile butadiene rubber), HBR (high-cis polybutadiene Rubber (BR)), NR (natural rubber), and combinations and mixtures thereof. In certain embodiments the waxed lines may be a waxed string or floss of any tough, durable, scratch-resistant polymeric material, including polyamide, polyaramid, polyester, and the like. One suitable example is nylon rigging floss known under the trade designation TUF-LINE™, a product of Western Filament, Inc., Grand Junction, Colo., presently available in 30, 50, and 70 lb. (rated test) spools. The spools are sold in (1, ¼) lb. spools, and purchasable at most tackle stores or online. "Nylon" is the name given to a whole family of very similar materials (some common names include nylon 6, nylon 6,6, and nylon 6, 10, for example) called polyamides, and the polyamides may be aliphatic, semi-aromatic, or combinations or mixtures thereof. See for example U.S. Pat. No. 2,071,250 (Wallace Carothers) and U.S. Pat. No. 8,618,225. In certain embodiments the polyvinyl alcohol ("PVA") may be selected from the PVAs described in U.S. Pat. No. 6,783,852 (assigned to Kuraray, describing water-soluble polyvinyl alcohols which satisfy the requirements: (1) a water absorption in water at 30° C. ranging from 10 to 100 times the weight of the fibers; (2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g.), U.S. Pat. Nos. 5,470,653 and 5,985,443 (both assigned to Isolyser, describing polyvinyl alcohols which are water soluble at temperatures above approximately 93° C.), all three of which are specifically incorporated herein by reference for their description of PVAs, fibers, and nonwovens made using those PVAs. In certain embodiments, the scratch-resistant mop may have an absorbance of water ranging from about 24 to 25 oz. water after wiping a wetted non-skid surface of 4,500 square feet, and testing absorbance, and durability of "Excellent" as apprised by a simple (unaided) visual human inspection (as described in the Examples herein).

A second aspect of the disclosure is a scratch-resistant mop comprising (or consisting of, or consisting essentially of):

a) a pole having first and second ends and an OD;

b) a rubber or rubber-coated end cap having an ID equal to or slightly less than the pole OD secured to the first end of the pole;

c) a plurality of strips of absorbent chamois material having a common end margin and each having a free end, the common end margin attached to the rubber or rubber-coated end cap using (preferably only) one or more scratch-resistant lines wrapped about the base of the rubber or rubber-coated plug, the absorbent chamois material selected from Kuraray and Isolyser absorbent chamois material, and combinations thereof; and d) the plurality of strips of absorbent material pulled tightly back over the secured common end margin and scratch-resistant lines so that end portions of the common end margins extend past the end cap, and all the strips are gathered and secured at a distal end of the end cap with a final scratch-resistant line, forming a scratch-resistant apple of the absorbent chamois material and the free ends.

A third aspect of the disclosure is a method of making the scratch-resistant mop of the first aspect, the method comprising (or consisting of, or consisting essentially of):

a) selecting the pole having first and second ends;
b) gluing the rubber or rubber-coated end cap onto the first end;
c) wrapping the common end margin of the absorbent chamois material about the rubber or rubber-coated end cap;
d) securing the wrapped common end margin to the base of the rubber or rubber-coated end cap by winding the one or more waxed lines over the common end margin about the base of the rubber or rubber-coated plug and tying the one or more waxed lines;
e) pulling the plurality of strips of absorbent material tightly back over the secured common end margin and one or more tied waxed lines so that end portions of the common end margins extend past the end cap, and all the strips of absorbent material are gathered at a distal end of the end cap; and
f) securing the plurality of strips of absorbent chamois material with the final waxed line, forming the scratch-resistant apple of the absorbent chamois material and the free ends.

These and other aspect and features of the scratch-resistant mops and methods of making same of this disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain scratch-resistant mops and methods may comprise a number of physical components and features, but may be devoid of certain optional hardware and/or other features. For example, certain mop embodiments may be devoid of metal components. Certain other mop embodiments may be devoid of any absorbent material other than polyvinyl alcohol material. Certain other mop embodiments may be devoid of any absorbent material other than polyvinyl alcohol materials described in the above-mentioned Kuraray and/or Isolyser patents.

BRIEF DESCRIPTION OF THE DRAWINGS

The manner in which the objectives of this disclosure and other desirable characteristics can be obtained is explained in the following description and attached drawings in which:

It is to be noted, however, that the appended drawings of FIGS. 1A, 1B, and 2-7 may not be to scale, and illustrate only typical apparatus embodiments of this disclosure. Furthermore, FIG. 8 illustrates only one of many possible methods of this disclosure. Therefore, while the drawing figures are considered to be part of the written description of the mops and methods of the present disclosure, they are not to be considered limiting in scope, for the disclosure may admit to other equally effective embodiments. Identical reference numerals are used throughout the several views for like or similar elements.

DETAILED DESCRIPTION

Figure 1A:
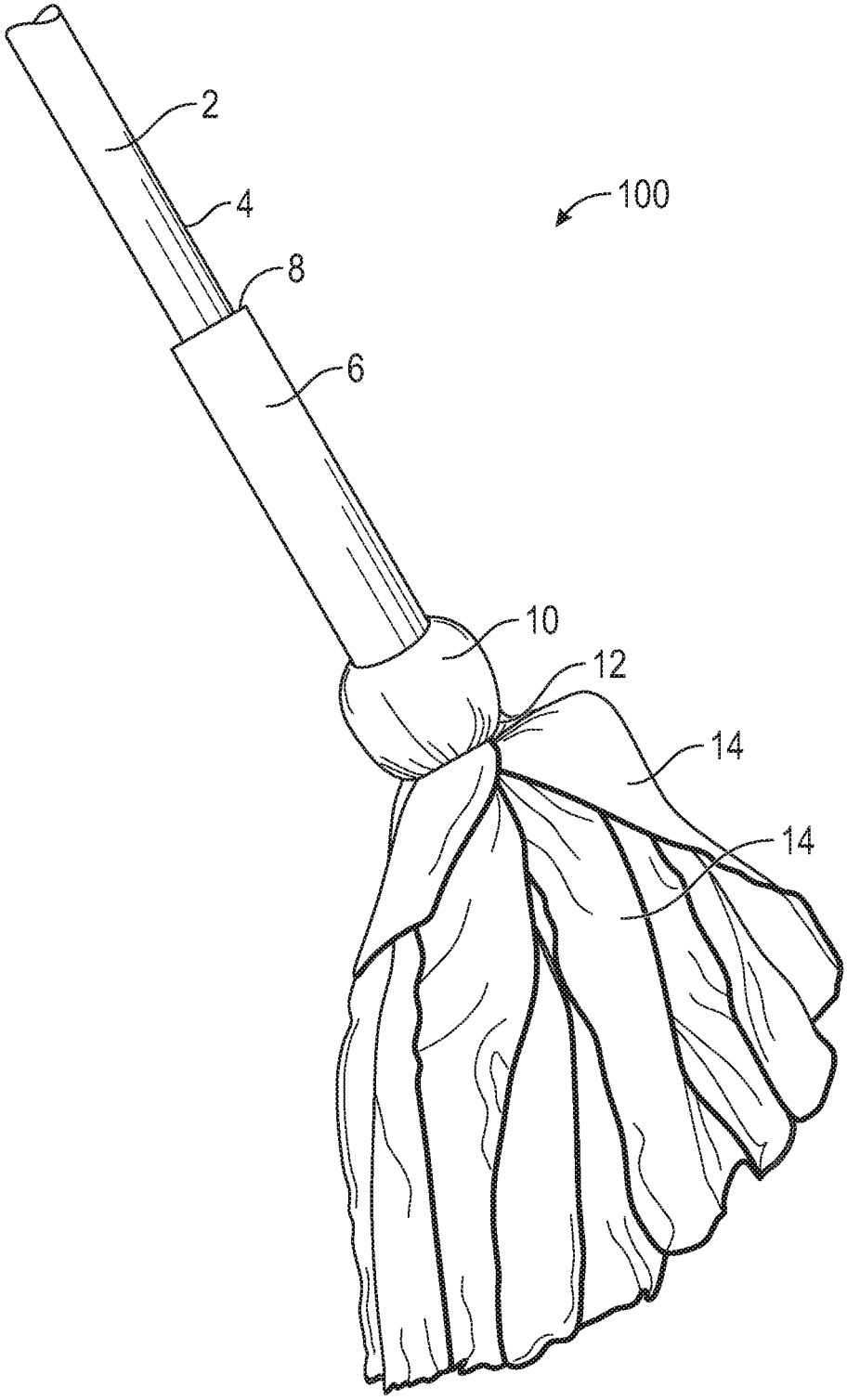
FIGS. 1A and 1B are schematic perspective views of one mop embodiment of the present disclosure, with FIG. 1B being an exploded perspective view.

In the following description, numerous details are set forth to provide an understanding of the mops and methods of the present disclosure. However, it will be understood by those skilled in the art that the apparatus, combinations, and methods disclosed herein may be practiced without these details and that numerous variations or modifications from the described embodiments may be possible. All U.S. published patent applications and U.S. patents referenced herein are hereby explicitly incorporated herein by reference, irrespective of the page, paragraph, or section in which they are referenced. Where a range of values describes a parameter, all sub-ranges, point values and endpoints of and within that range are explicitly disclosed herein.

As mentioned previously, there remains a need for more robust mops for marine cleaning and drying, particularly mops that reduce exposure of owners, guests and personnel to wet, slick surfaces and potential for injury. The mops and methods of making same of the present disclosure are directed to these needs.

As used herein, "scratch-resistant" means that the item in question will not easily scratch another surface or material when used properly. Obviously, any material that the mop may wipe is subject to being scratched if the mop is misused; however, the mops of the present disclosure are preferably scratch-resistant to wood, metal, and plastic vessels decks, hulls, and other components even when used in a rough or unconventional manner, due to the absence of metal components in the absorbent material and apple. (It is understood that in certain embodiments the mop handle (pole) may be metal, or have metal components near the non-mopping end of the handle, such as screws, rivets, and the like.) "Absorbent" and "absorbency" mean the property of retaining water, and is measured by the weight of the mop after many (typically 50) cycles of water soaking, wring out, wiping a non-slip surface, and weighing the mop. "Durability" of absorbent chamois material means resistance to becoming ragged looking in simple unaided visual appearance test by a human. "Scratch-resistant line" and "scratch-resistant string" are used interchangeably herein, in other words "line" and "string" are used interchangeably unless defined otherwise. The scratch-resistant mops and methods of the present disclosure are applicable to all surfaces that may require cleaning or drying.

"Durability" of absorbent chamois material means resistance to becoming ragged looking in simple unaided visual appearance test by a human. "Scratch-resistant line" and "scratch-resistant string" are used interchangeably herein, in other words "line" and "string" are used interchangeably unless defined otherwise. The scratch-resistant mops and methods of the present disclosure are applicable to all surfaces that may require cleaning or drying.

The primary features of the mops and methods of the present disclosure will now be described with reference to the drawing figures, after which some of the construction and operational details, some of which are optional, will be further explained.

Figure 1B:
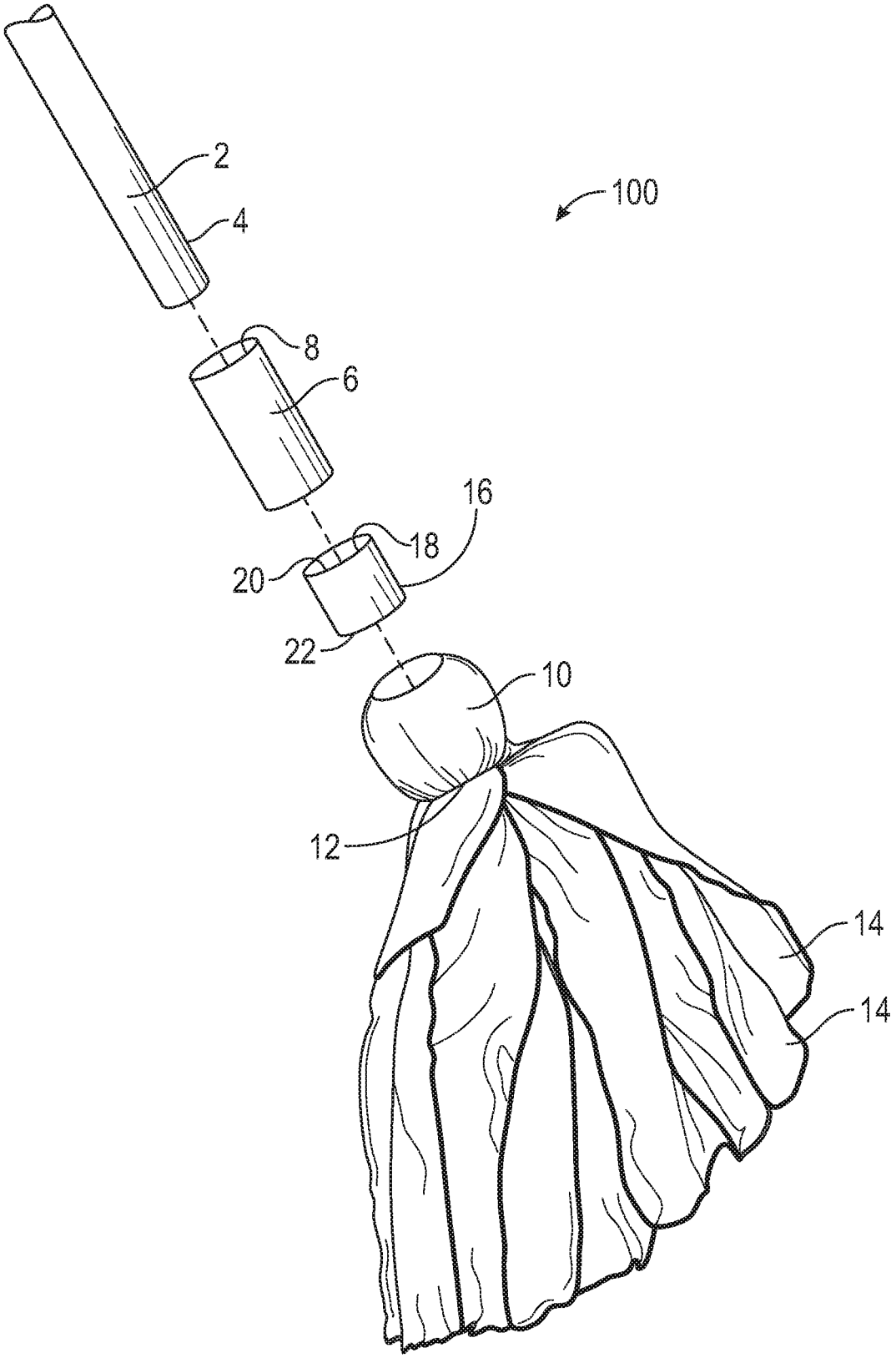

FIGS. 1A and 1B are schematic perspective views of one mop embodiment 100 of the present disclosure, with FIG. 1B being an exploded perspective view. Mop 100 includes a pole or handle 2 having an outside diameter 4; an optional foam rubber hand grip 6 (foam rubber being just an example), the hand grip having an internal diameter 8 substantially equal to the OD of pole 2. As used herein "substantially equal" in reference to the diameters means that, depending on the material of the hand grip, the ID of the hand grip may actually be slightly less than the OD of the pole before installation of the hand grip. Mop 100 includes a bunched region 10 of absorbent chamois materials referred to herein as an "apple" due to its shape. A waxed line 12 is tied tightly about a plurality of absorbent strips of chamois material 14. As illustrated more clearly in the exploded perspective view of FIG. 1B, the mop includes a rubber (or rubber-coated) end cap 16 having an ID 18, a base 20, and a top 22, about which apple 10 is formed, as further explained herein.

Figure 2:
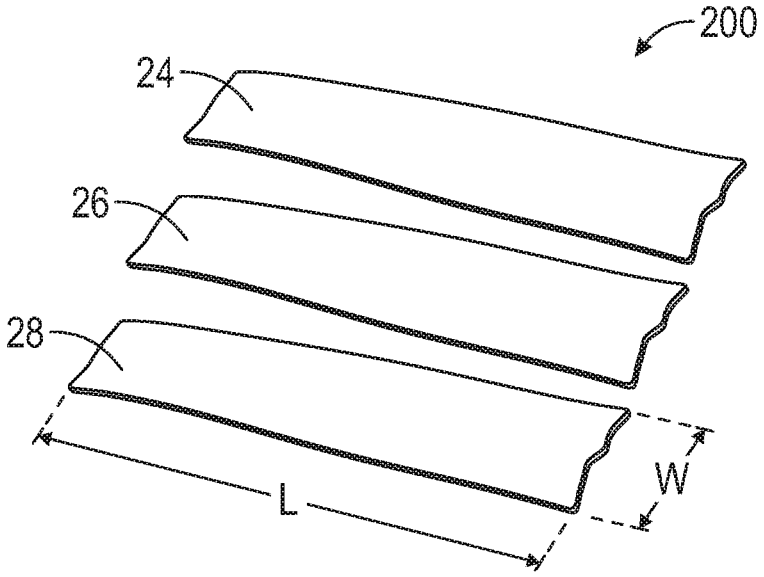
FIG. 2 is a schematic perspective view of three absorbent chamois sheets prior to being cut.

FIG. 2 is a schematic perspective view of one embodiment 200 of three absorbent chamois sheets 24, 26, and 28, each having substantially same length (L) and width (W) prior to being cut. The chamois length (L) and width (W) may vary widely. In certain embodiments the length (L) may range from about 100 to about 50 cm, or from about 90 to about 60 cm, or from about 80 to about 70 cm, or from about 70 to about 65 cm. Greater values of (L) at a constant (W) may make mops that are more absorbent, but may make the mops more difficult to use when nearing saturation. Lesser values of (L) at a constant (W) may result in less water absorbed. In certain embodiments the width (W) may range from about 60 to about 20 cm, or from about 50 to about 30 cm, or from about 45 to about 40 cm. Greater values of (W) at a constant (L) may make mops that are more absorbent, but may make the mops more difficult to use when nearing saturation. Lesser values of (W) at a constant (L) may result in less water absorbed.

Figure 3:
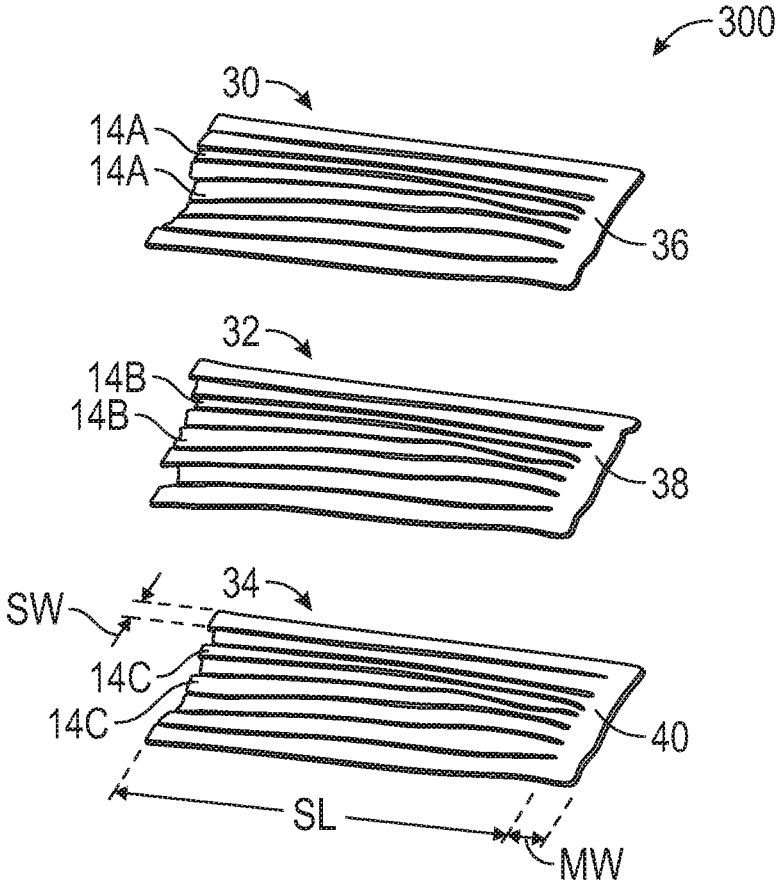
FIG. 3 is a schematic perspective view of the three absorbent chamois sheets illustrated schematically in FIG. 2 after being cut to form strips and common end margins.

FIG. 3 is a schematic perspective view of an embodiment 300 of absorbent chamois sheets 30, 32, and 34 after cutting the sheets 24, 26, and 28 illustrated schematically in FIG. 2 to form separate pluralities of strips of absorbent chamois material 14A, 14B, 14C, each having a common end margin 36, 38, and 40, respectively. In embodiment 300, each of the strips of each of the pluralities of strips 14A, 14B, and 14C have the same strip length (SL) and strip width (SW), and each of margins 36, 38, and 40 of respective chamois sheets 30, 32, and 34 have identical margin widths (MW). The strip length (SL) need not be the same, nor must the strip width (SW), but these may be the easiest embodiments to construct. The margin width (MW) need not be constant, be again these embodiments may be the easiest to construct. The strip width (SW) and margin width (MW) may vary widely. In certain embodiments the strip width (SW) may range from about 10 to about 0.5 cm, or from about 9 to about 1 cm, or from about 8 to about 4 cm, or from about 6 to about 4 cm. Greater values of (SW) at a constant chamois width (W) and length (L) may make mops that are more absorbent, but may be more difficult to mop around objects. Lesser values of (SW) at a constant chamois (W) and length (L) may result in more flexibility in mopping around objects. In certain embodiments the margin width (MW) may range from about 8 to about 0.5 cm, or from about 6 to about 3 cm, or from about 5 to about 4 cm. Greater values of (MW) at a constant chamois (L) may make mops having a large "apple", while lesser values of (MW) at a constant chamois (L) may result in a smaller "apple."

Figure 4:
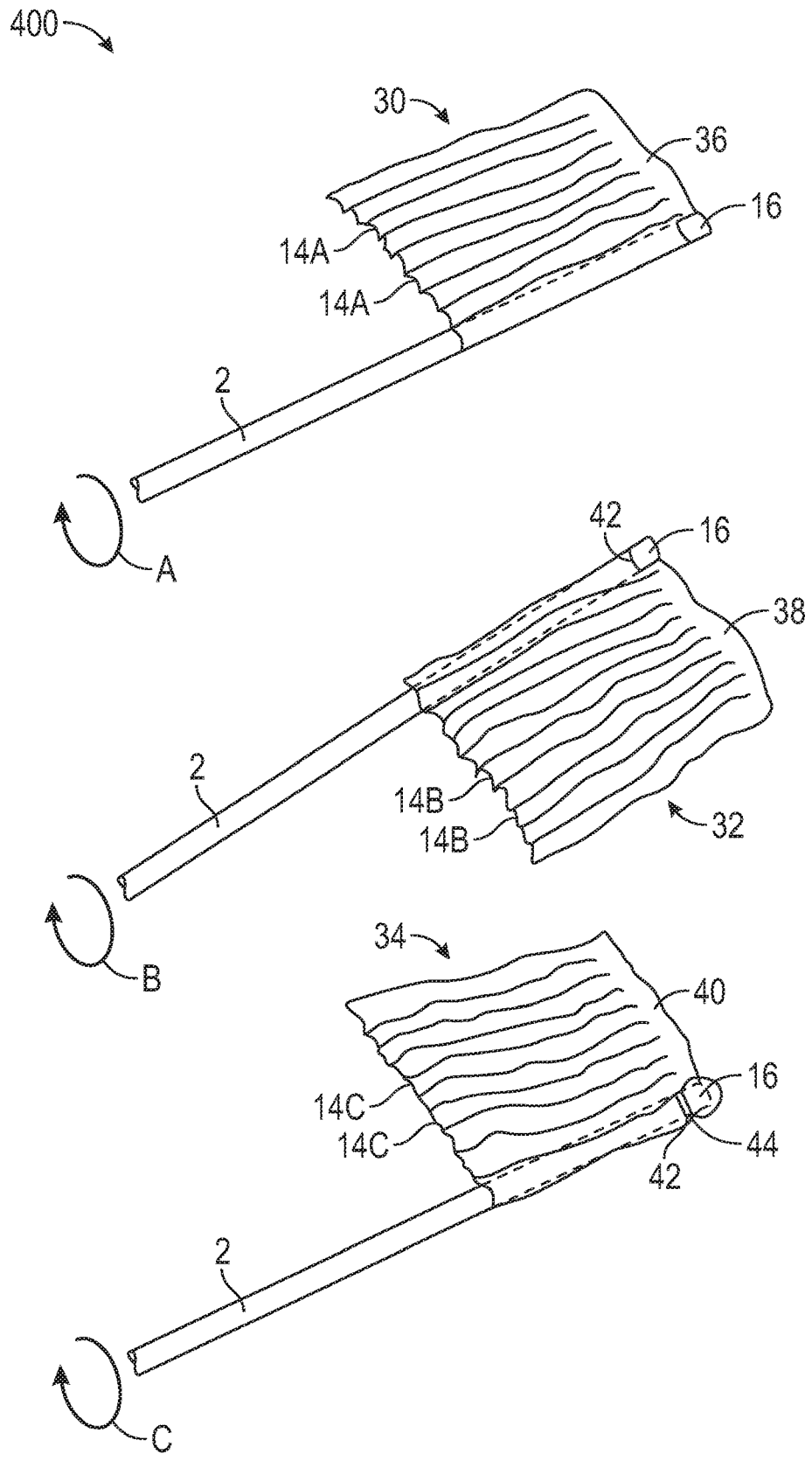
FIG. 4 is a schematic perspective view of the three absorbent chamois sheets as illustrated schematically in FIG. 3, illustrating three steps in one method of making the mop illustrated schematically in FIG. 1A, with some parts illustrated in phantom.

FIG. 4 is a schematic perspective view of the three cut absorbent chamois sheets 30, 32, and 34 as illustrated schematically in FIG. 3, illustrating three steps in one method 400 of making the mop illustrated schematically in FIG. 1A, with some parts illustrated in phantom. Cut absorbent chamois sheet 30 is laid on pole 2 as illustrated so that common end margin 36 may be wrapped tightly about end cap 16 (illustrated in phantom) in a first direction as indicated by circular arrow (A). A first waxed line 42 is wrapped about sheet 30 at the bottom of common end margin 36 and tied in a knot. Cut absorbent chamois sheet 32 is then laid on pole 2 as illustrated so that common end margin 38 may be wrapped tightly about end cap 16 and the previously wrapped common end margin 36 (both illustrated in phantom) in a second direction as indicated by circular arrow (B). A second waxed line 44 is wrapped about sheet 32 at the bottom of common end margin 38 and tied in a knot. Then, cut absorbent chamois sheet 34 is laid on pole 2 as illustrated so that common end margin 40 may be wrapped tightly about end cap 16, wrapped common end margins 36, 38 (all illustrated in phantom) in the first direction as indicated by circular arrow (C). A third waxed line 46 is wrapped about sheet 34 at the bottom of common end margin 40 and tied in a knot. First, second, and third waxed lines 42, 44, 46 may be said to form a seam.

Figure 5:
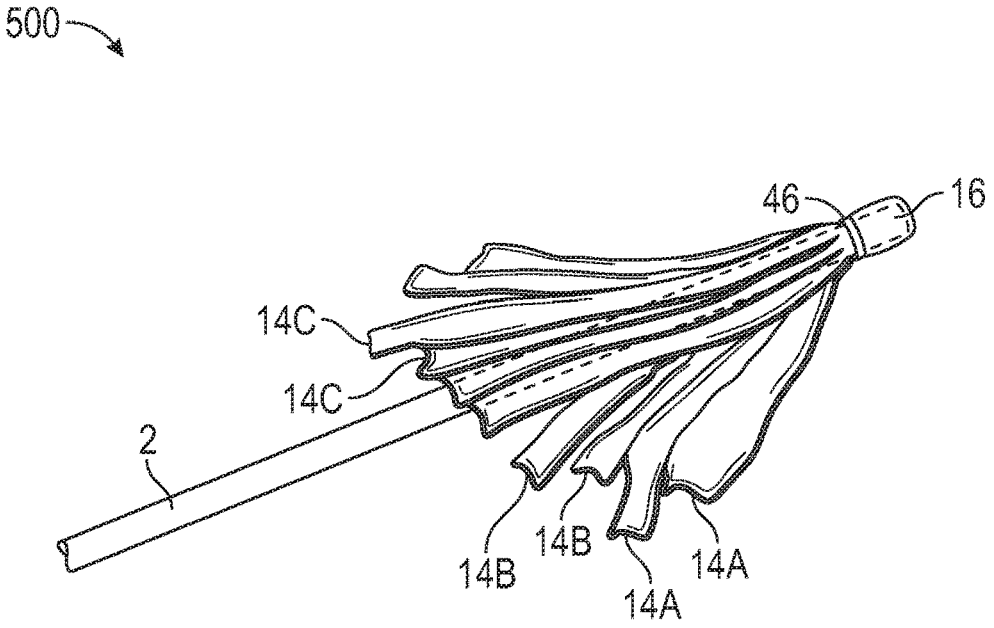
FIG. 5 is a schematic perspective view of a pre-mop after completing the steps illustrated schematically in FIG. 4 with some parts illustrated in phantom.

FIG. 5 is a schematic perspective view of a pre-mop embodiment 500 after completing the steps illustrated schematically in FIG. 4 with some parts illustrated in phantom.

Figure 6:
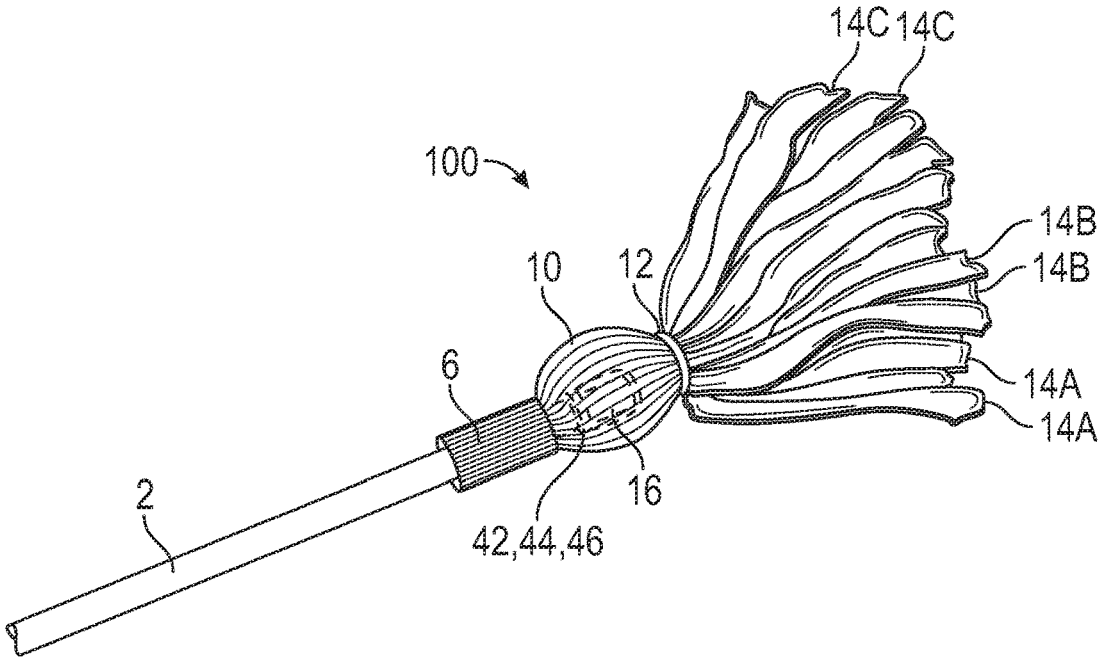
FIG. 6 is a schematic perspective view of the mop illustrated schematically in FIG. 1 after completing construction using the pre-mop illustrated schematically in FIG. 5, with some parts illustrated in phantom.

FIG. 6 is a schematic perspective view of mop 100 illustrated schematically in FIG. 1 after completing construction using the method embodiment 400 to construct the pre-mop embodiment 500 illustrated schematically in FIG. 5, with some parts illustrated in phantom. Specifically, first, second, and third waxed lines 42, 44, and 46, as well as end cap 16 are illustrated in phantom. Also illustrated is waxed line 12, sometimes referred to herein as the fourth waxed line. In order to produce mop 100 illustrated in FIG. 6 from the pre-mop illustrated in FIG. 500, one pulls all of the strips 14A, 14B, and 14C back toward and past end cap 16, generally parallel to pole 2. After tying waxed line 12 about the gather strips, apple 10 forms over the end cap, wrapped common end margins 36, 38, and 40, and the "seam" formed from previously wrapped waxed lines 42, 44, and 46.

Figure 7:
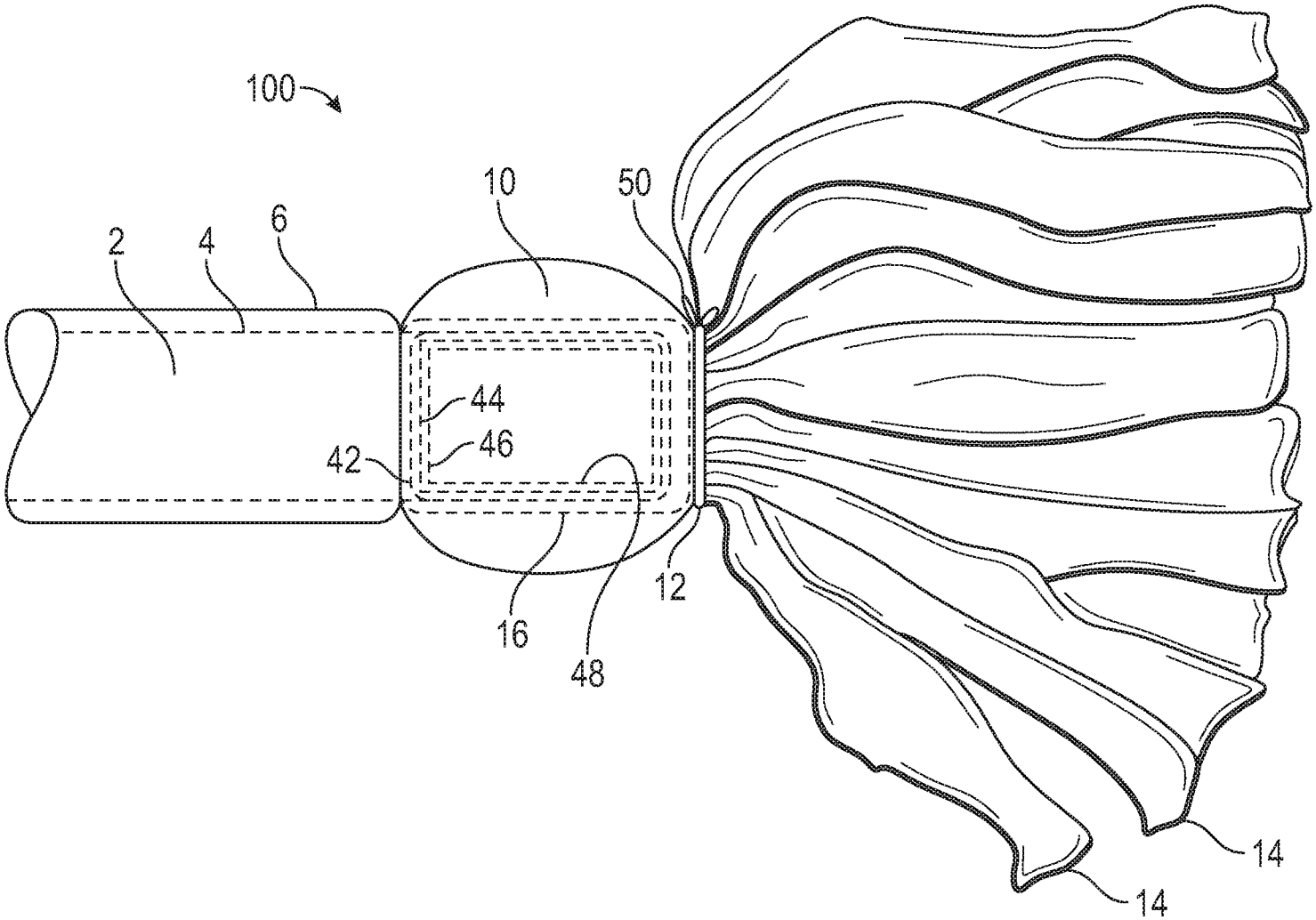
FIG. 7 is a close-up, schematic perspective view of the mop illustrated schematically in FIG. 6 after completing construction, with some parts illustrated in phantom.

FIG. 7 is a close-up, schematic perspective view of mop 100 illustrated schematically in FIG. 6 after completing construction, with some parts illustrated in phantom. Specifically, first, second, and third waxed lines 42, 44, and 46, as well as end cap 16 are illustrated in phantom, as well as glue or adhesive 48 and a knot 50. Glue 48 may be selected from any one of commercially available wood glue, rubber cement, and the like. One commonly used glue is PVC cement, such as Oatey PVC cement, presently available from any hardware store (for example Home Depot) or online. In certain embodiments, compression or friction fittings may be employed, without any glue or adhesive.

Figure 8:
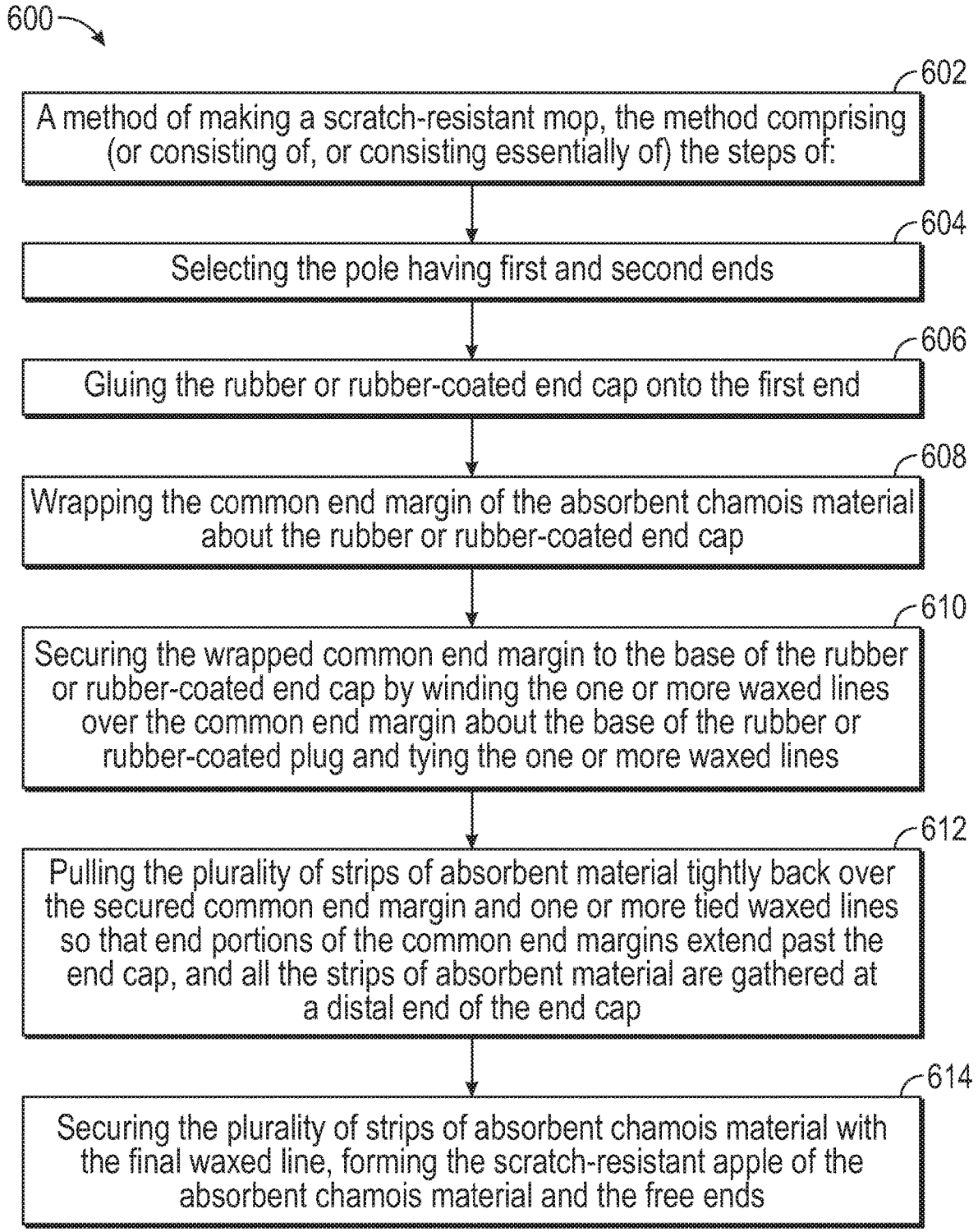
FIG. 8 is a logic diagram of one method of making a mop of the present disclosure.

FIG. 8 is a logic diagram of one method embodiment 600 of making a mop of the present disclosure. Method embodiment 600 of making a scratch-resistant mop, the method comprising (or consisting of, or consisting essentially of) the steps of (box 602) selecting the pole having first and second ends (box 604); gluing the rubber or rubber-coated end cap onto the first end (box 606); wrapping the common end margin of the absorbent chamois material about the rubber or rubber-coated end cap (box 608); securing the wrapped common end margin to the base of the rubber or rubber-coated end cap by winding the one or more waxed lines over the common end margin about the base of the rubber or rubber-coated plug and tying the one or more waxed lines (box 610); pulling the plurality of strips of absorbent material tightly back over the secured common end margin and one or more tied waxed lines so that end portions of the common end margins extend past the end cap, and all the strips of absorbent material are gathered at a distal end of the end cap (box 612); and securing the plurality of strips of absorbent chamois material with the final waxed line, forming the scratch-resistant apple of the absorbent chamois material and the free ends (box 614).

Suitable materials of construction of mops in accordance with this disclosure include natural and man-made rubber compounds, elastomeric compounds, thermoplastic-elastomeric compounds, and the like, with or without fillers, additives, coupling agents, and other optional additives, for the end caps and hand grips. In certain embodiments the rubber of the rubber end cap may be selected from EPDM, EPM, vinyl rubber, PVC, NBR, HBR, NR, and combinations and mixtures thereof. Hardwoods may be preferred for the pole, and these may be lacquered and/or painted.

The PVAs described in U.S. Pat. No. 6,783,852 are characterized by cross-linked polyvinyl alcohol fibers prepared from a water-soluble polyvinyl alcohol, which satisfy the following requirements: (1) a water absorption in water at 30° C. ranging from 10 to 100 times the weight of the fibers; (2) a fiber diameter in water at 30° C. as a result of absorbing water ranging from 2 to 10 times the diameter of the fibers not having absorbed water; and (3) a inciting point ranging from 160 to 220° C., and a heat of fusion ranging from 40 to 100 J/g. The PVAs described in U.S. Pat. Nos. 5,470,653 and 5,985,443 may be characterized by fibers of polyvinyl alcohol which is water soluble at temperatures above approximately 93° C. The polyvinyl alcohol fibers are produced by a process of dope extrusion and then treated with heat and stretching, the degree of crystallinity and the degree of orientation for the heated and stretched polyvinyl alcohol fibers are approximately 0.70 and 0.52, respectively. The degree of crystallinity and the degree of orientation are measured by IR spectroscopy. The degree of crystallinity is the ratio of crystalline area to amorphous area. The degree of orientation is the ratio of non-oriented area to oriented area. The water content of polyvinyl alcohol fiber is kept at a value between approximately 1.5 to 15.0% (wt.). The polyvinyl alcohol is further characterized as having a degree of polymerization between approximately 1300 to 1500 being produced from greater than 99% saponified polyvinyl acetate containing between approximately 0.1 to 5.0% (wt.) of an anti-blocking agent and 0.1 to 2.0% (wt.) of wetting agent.

As noted herein, the scratch-resistant mops of the present disclosure may be made using a method that both forms the scratch-resistant "apple" of the mops, and that also covers all but one of the waxed lines or other securing lines with absorbent chamois material. In certain embodiments, depending on how tightly the last line is secured, and how much the chamois material expands when water is absorbed therein, the absorbent chamois materials may substantially cover even the last line. In one embodiment, a painted wooden or fiberglass mop handle is used as the base. The handle has a rubber plug on each end; one on the top and one on the bottom. The plugs are glued on, using a glue or cement, one example being the Oatey PVC cement previously mentioned. The mop handle may have various lengths, with or without hand grips, such as foamed rubber hand grips. Three 26 in.×17 in. (66 cm×43 cm) polyvinyl alcohol chamois sheets are laid horizontally. Thirteen strips, each two inches (5 cm) wide, are cut vertically with a two-inch (5 cm) margin kept whole at one end (referred to herein the top) of the chamois. The margin is also referred to herein as the common end margin, since all the strips have one common end, and one free end. The first chamois is taken and the top of the margin is aligned with the top end of one of the plugs, referred to herein as the top plug. Each plug has a base end and a top end. The common end of the first chamois is wrapped tightly around the top plug in a first direction, while the strips are wrapped tightly around the pole, and then tied with a waxed line over the base of the top plug. At this point, the second chamois is applied by being wrapped in the opposite direction, and again tied tightly with a waxed line at the base of the plug (over the previous line, now the "seam"). The last chamois is wrapped above the second, in the direction of the first, and tied tightly on the "seam" with waxed line. Once all three chamois are wrapped tightly around the top plug of the pole or handle, all the strips of each chamois are pulled tightly in the opposite direction from which the strips lay, so that all of the two inch wide strips now hang away from the pole or handle, and the "seam" now represents the top of the chamois. At this point, all of the chamois are gathered and wrapped tightly at the top end of the top plug and a waxed line is used to secure the mop and creating the unique "scratch-free apple" discussed herein and illustrated schematically in the figures.

In certain embodiments the absorbent chamois strips may all have the same length and width, while in other embodiments the strips may be of random lengths and widths and width may vary along the length of single strips. In other embodiments, the strips may have a non-random pattern of two or more different lengths and two or more different widths. The number of sheets of absorbent material may vary from 1 to 20, or from 2 to 19, or from 3 to 18, and the like. The could absorbent chamois sheets and strips may all be comprised (or consist of, or consist essentially of) the same PVA compositions in each sheet. In other embodiments, the chamois sheets may vary in composition, for example PVA1 in sheet 1, PVA2 in sheet 2, and PVA3 in sheet 3, that sort of thing. The absorbency of the sheets and strips made therefrom may be the same or different in a single mop.

In certain embodiments, the pole or handle need not be round or tubular/cylindrical as illustrated in the drawings, but rather could take any shape, both in cross-section, and in contour (such as curved ski poles). Suitable pole cross-sections may be rectangular, elliptical, triangular, hemispherical or semi-hemispherical-shaped (dome-shaped), or combination thereof and the like, as long as the pole or handle has suitable fittings to allow connection of the absorbent chamois material in the methods described herein. It yet other embodiments, the pole or handle may have one or more rubber hand grips, reflective strips, LED lights, and the like. It will be understood that such embodiments are part of this disclosure and deemed with in the claims. Furthermore, one or more of the various components may be ornamented with various ornamentation produced in various ways (for example stamping or engraving, or raised features such as reflectors, reflective tape, including patterns of same in or on the pole or handle), such as sail fish designs, oil rig designs, oil tool designs, logos, letters, words, nicknames (for example ON LOCATION, and the like). Hand-grips may be machined or formed into the pole to have easy-to-grasp features for fingers, or may have rubber grips shaped and adorned with ornamental features, such as raised knobby gripper patterns.

Examples

Scratch-resistant mops of the present disclosure were tested for absorbance, durability, and appearance and compared with commercially available chamois mops.

A scratch-resistant mop of the present disclosure (designated herein as "Example Mop") was made using three identical 26 inch×17 inch sheets of PVA absorbent chamois material, each cut as described herein into 13 strips each having a width of 2 inches, and having a common end margin also of 2 inches width, the margin of the first sheet wrapped in one direction about a rubber end cap of a hardwood handle, the second sheet wrapped in the opposite direction, and the third sheet wrapped in the same direction as the first. Each PVA sheet was that known under the trade designation THE ABSORBER®, manufactured by Cleantools, Inc. Westmont, Ill. (USA), and obtained from West Marine, and secured using a single waxed nylon line known under the trade designation TUF-LINE™, obtained from a tackle store. As described herein, all the strips of the three sheets were then pulled in the opposite direction, and a fourth waxed line used to secure the strips together and form the scratch-resistant apple.

This mop (designated "Example Mop") and two competitive mops (designated "Comparative Mops A and B") were then tested in a combined absorbance and durability test.

Introduction

The following is a report on the functionality of one mop of the present disclosure through testing and evaluations of itself along with similar products currently on the market. A thorough analysis was conducted on the absorbency, durability, and functionality of three separate chamois mops, of which one was constructed in accordance with the present disclosure. The analysis consisted of two separate tests identified below.

Purpose:

The purpose of this study was to determine that mops made in accordance with the present disclosure are superior to other similar products currently on the market.

Study Area:

Three separate mops were tested in the evaluation:

Mop A: Shurhold quick-connect chamois mop.

Mop B: TD Mop on wooden handle.

Example Mop: A mop constructed in accordance with the present disclosure.

Methods:

Two tests were conducted, in each of which were several subparts (identified a., b., c.). Afterwards, a final evaluation was conducted by dissembling each mop and examining the internal system of each design.

Test 1: Absorbency a. As a newly manufactured product b. Post-drying a 3,000 square foot surface of polyester urethane topcoat (known under the trade designation AWLGRIP®, from AkzoNobel and West Marine) mixed with a blend of coarse and fine (50/50 blend) of aggregate (known under the trade designation AWLGRIP® GRIPTEX™ from AkzoNobel and West Marine).

c. Post-drying an additional 1,500 square foot (4,500 square foot total) surface of the same polyester urethane topcoat mixed with the same 50/50 blend of aggregate.

TEST 1 was conducted using each mop in the following steps:

1. Dry mop is removed from packaging and saturated with water in a 5 gallon bucket.
2. Mop is thoroughly wrung out (all wringing out was done by hand).
3. Mop is saturated in bucket for 10 seconds.
4. Mop is removed from bucket and held vertically chamois-down for 30 seconds to allow excess water to drip off.
5. Mop is thoroughly wrung out into a dry bucket.
6. The water removed from the mop is measured to determine absorbency.
7. The water absorbency for each mop is tested three separate times and the average of the three results are taken and rounded to the nearest ounce.

Test 2: Durability/Functionality a. After drying a 3,000 square foot surface of the polyester urethane topcoat mixed with the blend of coarse and fine aggregate (50/50 blend) used in Test 1.

b. After drying an additional 1,500 square foot surface (4,500 square foot total) of the same polyester urethane topcoat mixed with the same blend of coarse and fine aggregate (50/50 blend) used in Test 1.

During each subpart of TEST 2 notes were taken to determine how many wring-outs it took to dry the specified surface areas.

A scale was used to evaluate durability by simple unaided visual inspection in sunlight: (E) for excellent, (BA) for better than average, (A) for average, (LA) for less than average, and (P) for poor.

Both TEST 1 and TEST 2 were conducted outdoors with an ambient temperature of approximately 84° F. (29° C.) with approximately 70% relative humidity.

FINAL EVALUATION: Upon completion of both tests, each mop was dissembled and evaluated for its internal design.

RESULTS: Tables I-VI present the results.

TABLE I

Initial Water Absorbency
TEST 1. a.

| Title: | Absorbency (oz.) |
|---|---|
| Mop A | 19 |
| Mop B | 18 |
| Example Mop | 25 |

TABLE II

| Intermediate Water Absorbency TEST 1. b. | |
|---|---|
| Title: | Absorbency (oz.) |
| Mop A | 15 |
| Mop B | 16 |
| Example Mop | 25 |

TABLE III

| Final Water Absorbency TEST 1. c. | |
|---|---|
| Title: | Absorbency (oz.) |
| Mop A | 14 |
| Mop B | 14 |
| Example Mop | 24 |

TABLE IV

| Intermediate Durability TEST 2. a | | |
|---|---|---|
| Title: | # of Wring-Outs | # of Legs Lost |
| Mop A | 92 | 1 |
| Mop B | 86 | 1 |
| Mop C | 58 | 0 |

TABLE V

| Final Durability TEST 2. b. | | |
|---|---|---|
| Title: | # of Wring-Outs | # of Legs Lost |
| Mop A | 51 | +2 |
| Mop B | 55 | +5 |
| Example Mop | 26 | 0 |

TABLE VI

| Construction Details FINAL EVALUATION | |
|---|---|
| Title: | COMMENTS: |
| Mop A | Assembled on a metal rod with two external metal "arms," chamois material is attached with a ¼" metal clamp and waxed line. |
| Mop B | Assembled on a wooden rod, chamois material is attached with twisted metal wire and waxed line. |
| Example Mop | Assembled on a wooden rod, the chamois material is attached with waxed line. |

Conclusion:

In the initial absorbency test (TEST 1.a., Table I), the Example Mop absorbed 24% more water than the Shurhold quick-connect mop, and 28% more than the TD mop.

In order to dry 3,000 square foot of polyester urethane topcoat mixed with the described blend of aggregate (coarse and fine 50/50 blend) (henceforth referred to as non-skid) (TEST 2.a., Table IV), the Shurhold mop lost 2 of its legs and needed to be wrung-out 1.6 times more than the Example Mop. The TD mop lost 1 of its legs and needed to be wrung-out 1.5 times more than the Example Mop. The Example Mop received little wear during TEST 2.a. and was rated as E—Excellent. Both the Shurhold and TD Mops were rated as LA—Less than average.

After TEST 2.a. (Table IV), the TEST 1.b. (Table II) results showed that the Example Mop absorbed 40% more water than the Shurhold, and 36% more water than the TD mop. While the Shurhold and TD mops had dropped absorbency rates of several ounces each, the absorbency rate of the Example Mop remained the same.

During TEST 2.b. (Table V) of the study, the Shurhold mop lost two additional legs and needed to be wrung-out 1.9 times more than the Example Mop. The TD mop lost an additional 5 legs during the test and needed to be wrung-out 2.1 times more than the Example Mop. The quality of the Example Mop remained E—Excellent, yet both the Shurhold and TD mops fell to P—Poor.

The final absorbency test (TEST 1.c., Table III), measured after each mop dried 4,500 square foot of non-skid, determined that the Example Mop absorbed 42% more water than both the Shurhold and TD mops. Additionally, the Example Mop suffered little wear and lost only 1 oz. of water retention, whereas the Shurhold lost a total of 5 oz. and the TD mop lost a total of 4 oz., each ending with a total of 10 oz. of less water retention than the Example Mop.

During the Final Evaluation of the mops, both the Shurhold and TD mops contained one or more pieces of metal that could cause serious damage to paint, fiberglass, or other fine finishes. In contrast, the Example Mop contained nothing but soft material. In view of the data from these tests, it was unexpected that similar appearing mops proved to be drastically different in absorbency and durability. As may be readily seen from the data in Tables I-VI, the scratch-resistant mops and methods described herein provide a durable, highly absorbent product that should be highly desired by owners not only for its durability and absorbent properties, but also for its cost savings due to less mop purchases and increased safety due to drier surfaces after mopping.

Embodiments disclosed herein include:

A: A scratch-resistant mop comprising (or consisting of, or consisting essentially of):

a) a pole (preferably hardwood, lacquered; or fiberglass reinforced plastic (FRP)) having first and second ends and an OD;

b) a rubber or rubber-coated end cap having an ID equal to or slightly less than the pole OD secured to the first end of the pole;

c) a plurality of strips of absorbent chamois material having a common end margin and each having a free end, the common end margin attached to the rubber or rubber-coated end cap using (only) one or more waxed lines wrapped over the common end margin about the base of the rubber or rubber-coated plug; and d) the plurality of strips of absorbent material pulled tightly back over the secured common end margin and waxed lines so that end portions of the common end margins extend past the end cap, and all the strips are gathered and secured at a distal end of the end cap with a final waxed line, forming a scratch-resistant apple of the absorbent chamois material and the free ends.

B. A scratch-resistant mop comprising (or consisting of, or consisting essentially of):

a) a pole having first and second ends and an OD;

b) a rubber or rubber-coated end cap having an ID equal to or slightly less than the pole OD secured to the first end of the pole;

c) a plurality of strips of absorbent chamois material having a common end margin and each having a free end, the common end margin attached to the rubber or rubber-coated end cap using (only) one or more scratch-resistant lines wrapped about the base of the rubber or rubber-coated plug, the absorbent chamois material selected from Kuraray and Isolyser absorbent chamois material, and combinations thereof; and d) the plurality of strips of absorbent material pulled tightly back over the secured common end margin and scratch-resistant lines so that end portions of the common end margins extend past the end cap, and all the strips are gathered and secured at a distal end of the end cap with a final scratch-resistant line, forming a scratch-resistant apple of the absorbent chamois material and the free ends.

C: A method of making a scratch-resistant mop, the method comprising (or consisting of, or consisting essentially of):

a) selecting the pole having first and second ends;

b) gluing the rubber or rubber-coated end cap onto the first end;

c) wrapping the common end margin of the absorbent chamois material about the rubber or rubber-coated end cap;

d) securing the wrapped common end margin to the base of the rubber or rubber-coated end cap by winding the one or more waxed lines over the common end margin about the base of the rubber or rubber-coated plug and tying the one or more waxed lines;

e) pulling the plurality of strips of absorbent material tightly back over the secured common end margin and one or more tied waxed lines so that end portions of the common end margins extend past the end cap, and all the strips of absorbent material are gathered at a distal end of the end cap; and f) securing the plurality of strips of absorbent chamois material with the final waxed line, forming the scratch-resistant apple of the absorbent chamois material and the free ends.

D: A method of making a scratch-resistant mop, the method comprising (or consisting of, or consisting essentially of):

a) selecting:

i) the lacquered hardwood pole having the first and second ends;

ii) the rubber end cap from rubbers selected from EPDM, vinyl rubber, PVC, NBR, HBR, NR, and combinations and mixtures thereof;

iii) the three absorbent chamois material sheets from chamois material selected from the group consisting of (Kuraray PVA and Isolyser PVA); and the first, second, third, and final waxed lines;

b) gluing the rubber end cap onto the first end of the lacquered hardwood pole;

c) wrapping the common end margin of the first absorbent chamois material about the rubber end cap in the first direction, and securing the common end margin of the first absorbent chamois material about the rubber end cap by winding the first waxed line over the common end margin of the first absorbent chamois material, and tying the first waxed line;

d) wrapping the common end margin of the second absorbent chamois material over the wrapped common end margin of the first absorbent chamois material in the direction opposite the first direction, and securing the common end margin of the second absorbent chamois material over the wrapped common end margin of the first absorbent chamois material by winding the second waxed line over the common end margin of the second absorbent chamois material, and tying the second waxed line;

e) wrapping the common end margin of the third absorbent chamois material over the wrapped common end margin of the second absorbent chamois material in the first direction, and securing the common end margin of the third absorbent chamois material over the wrapped common end margin of the second absorbent chamois material by winding the third waxed line over the common end margin of the second absorbent chamois material, and tying the third waxed line;

f) pulling the plurality of strips of absorbent material tightly back over the secured first, second, and third common end margins and the tied third waxed line so that end portions of the common end margins extend past the end cap, and all the strips of absorbent material are gathered at a distal end of the end cap; and g) securing the plurality of strips of absorbent chamois material with the final waxed line, forming the scratch-resistant apple of the absorbent chamois material and the free ends.

E: A method of making a scratch-resistant mop, the method comprising (or consisting of, or consisting essentially of):

a) selecting the pole having first and second ends;

b) gluing the rubber or rubber-coated end cap onto the first end;

c) wrapping the common end margin of the absorbent chamois material about the rubber or rubber-coated end cap, the absorbent chamois material selected from the group consisting of (Kuraray PVA and Isolyser PVA);

d) securing the wrapped common end margin to the base of the rubber or rubber-coated end cap by winding the one or more scratch-resistant lines over the common end margin about the base of the rubber or rubber-coated plug and tying the one or more scratch-resistant lines;

e) pulling the plurality of strips of absorbent material tightly back over the secured common end margin and one or more tied scratch-resistant lines so that end portions of the common end margins extend past the end cap, and all the strips of absorbent material are gathered at a distal end of the end cap; and f) securing the plurality of strips of absorbent chamois material with the final scratch-resistant line, forming the scratch-resistant apple of the absorbent chamois material and the free ends.

Each of the embodiments A, B, C, I) and E may have one or more of the following additional elements in any combination:

Element 1: the pole is hardwood.

Element 2: the pole of FRP.

Element 3: the rubber or rubber-coated end cap is glued to the first end of the pole.

Element 4: the plurality of strips of absorbent chamois material are derived from first, second, and third sheets of the absorbent chamois material, each cut lengthwise into strips about 90 percent of their length, each strip having a strip width and forming the plurality of absorbent chamois material strips, the plurality of strips of absorbent chamois material each having a having a respective first, second, and third common end margin.

Element 5: the respective common end margin of the first, second, and third absorbent chamois material sheets is wrapped about the rubber or rubber-coated end cap, the common end margin of the first sheet wrapped in a first direction, the common end margin of the second sheet wrapped in a direction opposite the first direction, and the common end margin of the third sheet wrapped in the first direction, and the one or more waxed lines comprises (or consists of, or consists essentially of) a first waxed line securing the wrapped common end margin of the first sheet, a second waxed line securing the wrapped common end margin of the second sheet, a third waxed line securing the wrapped common end margin of the third sheet, the first, second, and third waxed lines positioned in substantially the same longitudinal position about the base of the rubber or rubber-coated end cap, and a final waxed line securing the gathered strips of absorbent chamois material at a top of the rubber or rubber-coated end cap, the apple of the absorbent chamois material formed between the base and the top of the rubber or rubber-coated end cap.

Element 6: each of the plurality of strips of absorbent chamois material are comprised (or consist of, or consist essentially of) polyvinyl alcohol fibers, or nonwoven made of PVA fibers.

Element 7: the polyvinyl alcohol is selected from Kuraray and Isolyser.

Element 8: the pole is lacquered hardwood.

Element 9: the rubber is selected from EPDM, vinyl rubber, PVC, NBR, HBR, NR, and combinations and mixtures thereof.

Element 10: the waxed lines are waxed nylon floss.

Element 11: the scratch-resistant mop may have an absorbance of water up to about 20, or 21, or 22, or 23, or 24, or 25 oz. water after wiping a wetted non-skid surface of 4,500 square feet, and testing absorbance, and durability of "Excellent" as apprised by a simple (unaided) visual human inspection.

Element 12: the plurality of strips are derived from three different PVA sheets PVA1, PVA2, and PVA3, each of the different absorbency, the absorbency obeys PVA1>PVA2>PVA3, and PVA1 is wrapped first about the end cap, PVA2 second, and then PVA3, and strip length obeys PVA1=PVA2=PVA3.

From the foregoing detailed description of specific embodiments, it should be apparent that patentable apparatus, combinations, and methods have been described. Although specific embodiments of the disclosure have been described herein in some detail, this has been done solely for the purposes of describing various features and aspects of the apparatus and methods and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, one modification would be to take an existing mop and modify it to include a set of improved durability, highly absorbent chamois sheets such as disclosed herein, and attached to an existing pole or handle as described herein to form the scratch-resistant apple, with waxed-lines securing the chamois materials.

What is claimed is:

1. A scratch-resistant mop comprising:

a) a pole having first and second ends and an outer diameter (OD);

b) a rubber or rubber-coated end cap having an inner diameter (ID) equal to or slightly less than the pole OD secured to the first end of the pole;

c) a plurality of strips of absorbent chamois material each having a common end margin and each having a free end, each of the common end margins attached to the rubber or rubber-coated end cap using one or more waxed lines wrapped over the common end margin about a base of the rubber or rubber-coated end cap, the plurality of strips of absorbent chamois material are derived from first, second, and third sheets of the absorbent chamois material, each cut lengthwise to form the respective plurality of absorbent chamois material strips, each strip having a strip width, the plurality of strips of absorbent chamois material each having a respective first, second, and third common end margin;

d) the respective common end margin of the first, second, and third absorbent chamois material sheets is wrapped about the rubber or rubber-coated end cap, the common end margin of the first sheet wrapped in a first direction, the common end margin of the second sheet wrapped in a direction opposite the first direction, and the common end margin of the third sheet wrapped in the first direction, the common end margins secured using one or more waxed lines; and e) the plurality of strips of absorbent chamois material pulled tightly back over the secured common end margin and the one or more waxed lines so that end portions of the common end margins extend past the end cap, and all the strips are gathered and secured at a distal end of the end cap with a final waxed line, forming a scratch-resistant apple of the absorbent chamois material and the free ends.

2. The scratch-resistant mop of claim 1 wherein the pole is hardwood.

3. The scratch-resistant mop of claim 1 wherein the pole is fiberglass reinforced plastic (FRP).

4. The scratch-resistant mop of claim 1 wherein the rubber or rubber-coated end cap is glued to the first end of the pole.

5. The scratch-resistant mop of claim 1 wherein the one or more waxed lines comprises a first waxed line securing the wrapped common end margin of the first sheet, a second waxed line securing the wrapped common end margin of the second sheet, a third waxed line securing the wrapped common end margin of the third sheet, the first, second, and third waxed lines positioned in substantially the same longitudinal position about the base of the rubber or rubber-coated end cap.

6. The scratch-resistant mop of claim 1 wherein each of the plurality of strips of absorbent chamois material are comprised polyvinyl alcohol.

7. A scratch-resistant mop comprising:

a) a pole having first and second ends and an outer diameter (OD);

b) a rubber or rubber-coated end cap having an inner diameter (ID) equal to or slightly less than the pole OD secured to the first end of the pole;

c) a plurality of strips of absorbent chamois material having a common end margin and each having a free end, the common end margin attached to the rubber or rubber-coated end cap using one or more waxed lines wrapped about a base of the rubber or rubber-coated end cap;

d) the plurality of strips of absorbent chamois material pulled tightly back over the secured common end margin and the one or more waxed lines so that end portions of the common end margins extend past the end cap, and all the strips are gathered and secured at a distal end of the end cap with a final waxed line, forming a scratch-resistant apple of the absorbent chamois material and the free ends;

e) the plurality of strips of absorbent chamois material are derived from first, second, and third sheets of the absorbent chamois material, each cut lengthwise into strips about 90 percent of their length, each strip having a strip width and forming the plurality of absorbent chamois material strips, the plurality of strips of absorbent chamois material each having a having a respective first, second, and third common end margin;

f) the respective common end margin of the first, second, and third absorbent chamois material sheets is wrapped about the rubber or rubber-coated end cap, the common end margin of the first sheet wrapped in a first direction, the common end margin of the second sheet wrapped in a direction opposite the first direction, and the common end margin of the third sheet wrapped in the first direction;

g) the one or more waxed lines comprising a first waxed line securing the wrapped common end margin of the first sheet, a second waxed line securing the wrapped common end margin of the second sheet, a third waxed line securing the wrapped common end margin of the third sheet, the first, second, and third waxed lines positioned in substantially the same longitudinal position about the base of the rubber or rubber-coated end cap, and a final waxed line securing the gathered strips of absorbent chamois material at the distal end of the rubber or rubber-coated end cap, the apple of the absorbent chamois material formed between the base and the distal end of the rubber or rubber-coated end cap; and h) wherein each of the plurality of strips of absorbent chamois material are comprised of polyvinyl alcohol.

8. The scratch-resistant mop of claim 7 wherein:

i) the pole is lacquered hardwood;

ii) the rubber is selected from terpolymer of ethylene, propylene, and diene monomer (EPDM), vinyl rubber, polyvinyl chloride (PVC), nitrile butadiene rubber (NBR), high-cis polybutadiene Rubber (HBR), natural rubber (NR), and combinations and mixtures thereof;

iii) the waxed lines are waxed nylon floss; and iv) the polyvinyl alcohol is selected from polyvinyl alcohols (A) which satisfy the requirements: (1) a water absorption in water at 30° C. ranging from 10 to 100 times the weight of the fibers; (2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g, and (B) which are water soluble at temperatures above approximately 93° C.

9. The scratch-resistant mop of claim 7 having an absorbance of water up to about 25 oz. water after wiping a wetted non-skid surface of 4,500 square feet, and testing absorbance, and durability of "Excellent" as apprised by a simple unaided visual human inspection, wherein a scale is used to evaluate the durability by the simple unaided visual human inspection in sunlight: (E) for excellent, (BA) for better than average, (A) for average, (LA) for less than average, and (P) for poor, and wherein the testing of absorbance and durability are conducted outdoors at an ambient temperature of approximately 84° F. (29° C.) with approximately 70% relative humidity.

10. A scratch-resistant mop comprising:

a) a pole having first and second ends and an outer diameter (OD);

b) a rubber or rubber-coated end cap having an inner (ID) equal to or slightly less than the pole OD secured to the first end of the pole;

c) a plurality of strips of absorbent chamois material each having a common end margin and each having a free end, each of the common end margins attached to the rubber or rubber-coated end cap using one or more scratch-resistant lines wrapped about a base of the rubber or rubber-coated end cap, the absorbent chamois material selected from (A) polyvinyl alcohol (PVA) materials which satisfy the requirements: (1) a water absorption in water at 30° C. ranging from 10 to 100 times the weight of the fibers; (2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g, and (B) polyvinyl alcohol materials which are water soluble at temperatures above approximately 93° C., and combinations of (A) and (B);

d) the plurality of strips of absorbent chamois material are derived from first, second, and third sheets of the absorbent chamois material, each cut lengthwise to form the respective plurality of absorbent chamois material strips, each strip having a strip width, the plurality of strips of absorbent chamois material each having a respective first, second, and third common end margin;

e) the respective common end margin of the first, second, and third absorbent chamois material sheets is wrapped about the rubber or rubber-coated end cap, the common end margin of the first sheet wrapped in a first direction, the common end margin of the second sheet wrapped in a direction opposite the first direction, and the common end margin of the third sheet wrapped in the first direction, the common end margins secured using one or more waxed lines; and f) the plurality of strips of absorbent chamois material pulled tightly back over the secured common end margin and scratch-resistant lines so that end portions of the common end margins extend past the end cap, and all the strips are gathered and secured at a distal end of the end cap with a final scratch-resistant line, forming a scratch-resistant apple of the absorbent chamois material and the free ends.

11. The scratch-resistant mop of claim 10 wherein the pole is selected from the group consisting of hardwood, metal, fiberglass reinforced plastic (FRP), polyvinyl chloride (PVC), and combinations thereof.

12. The scratch-resistant mop of claim 10 wherein the rubber or rubber-coated end cap is glued to the first end of the pole.

13. The scratch-resistant mop of claim 10 wherein the plurality of strips of absorbent chamois material derived from first, second, and third sheets of the absorbent chamois material are each cut lengthwise into strips about 90 percent of their length.

14. The scratch-resistant mop of claim 13 wherein the one or more waxed lines comprising a first waxed line securing the wrapped common end margin of the first sheet, a second waxed line securing the wrapped common end margin of the second sheet, a third waxed line securing the wrapped common end margin of the third sheet, the first, second, and third waxed lines positioned in substantially the same longitudinal position about the base of the rubber or rubber-coated end cap, and a final waxed line securing the gathered strips of absorbent chamois material at the distal end of the rubber or rubber-coated end cap, the apple of the absorbent chamois material formed between the base and the distal end of the rubber or rubber-coated end cap.

15. The scratch-resistant mop of claim 10 wherein the plurality of strips are derived from three different PVA sheets PVA1, PVA2, and PVA3, each of the different absorbency, the absorbency obeys PVA1>PVA2>PVA3, and PVA1 is wrapped first about the end cap, PVA2 second, and then PVA3, and strip length (SL) obeys PVA1=PVA2=PVA3.

16. The scratch-resistant mop of claim 10 having an absorbance of water up to about 25 oz. water after wiping a wetted non-skid surface of 4,500 square feet, and testing absorbance, and durability of "Excellent" as apprised by a simple unaided visual human inspection, wherein a scale is used to evaluate the durability by the simple unaided visual human inspection in sunlight: (E) for excellent, (BA) for better than average, (A) for average, (LA) for less than average, and (P) for poor, and wherein the testing of absorbance and durability are conducted outdoors at an ambient temperature of approximately 84° F. (29° C.) with approximately 70% relative humidity.

17. A method of making the scratch-resistant mop of claim 1 comprising the steps of:

a) selecting the pole having the first and second ends;

b) gluing the rubber or rubber-coated end cap onto the first end;

c) wrapping the common end margins of the absorbent chamois material about the rubber or rubber-coated end cap in alternate directions;

d) securing the wrapped common end margin to the base of the rubber or rubber-coated end cap by winding the one or more waxed lines over the common end margin about the base of the rubber or rubber-coated end cap and tying the one or more waxed lines;

e) pulling the plurality of strips of absorbent chamois material tightly back over the secured common end margin and one or more tied waxed lines so that end portions of the common end margins extend past the end cap, and all the strips of absorbent chamois material are gathered at the distal end of the end cap; and f) securing the plurality of strips of absorbent chamois material with the final waxed line, forming the scratch-resistant apple of the absorbent chamois material and the free ends.

18. A method of making the scratch-resistant mop of claim 8, the method comprising the steps of:

a) selecting:

i) the lacquered hardwood pole having the first and second ends;

ii) the rubber end cap from rubbers selected from terpolymer of ethylene, propylene, and diene monomer (EPDM), vinyl rubber, polyvinyl chloride (PVC), nitrile butadiene rubber (NBR), high-cis polybutadiene Rubber (HBR), natural rubber (NR), and combinations and mixtures thereof;

iii) the three absorbent chamois material sheets from chamois material selected from the group consisting of polyvinyl alcohols (A) which satisfy the requirements: (1) a water absorption in water at 30° C. ranging from 10 to 100 times the weight of the fibers; (2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g, and (B) which are water soluble at temperatures above approximately 93° C.; and iv) the first, second, third, and final waxed lines; and b) gluing the rubber end cap onto the first end of the lacquered hardwood pole;

c) wrapping the common end margin of the first absorbent chamois material about the rubber end cap in the first direction, and securing the common end margin of the first absorbent chamois material about the rubber end cap by winding the first waxed line over the common end margin of the first absorbent chamois material, and tying the first waxed line;

d) wrapping the common end margin of the second absorbent chamois material over the wrapped common end margin of the first absorbent chamois material in the direction opposite the first direction, and securing the common end margin of the second absorbent chamois material over the wrapped common end margin of the first absorbent chamois material by winding the second waxed line over the common end margin of the second absorbent chamois material, and tying the second waxed line;

e) wrapping the common end margin of the third absorbent chamois material over the wrapped common end margin of the second absorbent chamois material in the first direction, and securing the common end margin of the third absorbent chamois material over the wrapped common end margin of the second absorbent chamois material by winding the third waxed line over the common end margin of the second absorbent chamois material, and tying the third waxed line;

f) pulling the plurality of strips of absorbent chamois material tightly back over the secured first, second, and third common end margins and the tied third waxed line so that end portions of the common end margins extend past the end cap, and all the strips of absorbent chamois material are gathered at the distal end of the end cap; and g) securing the plurality of strips of absorbent chamois material with the final waxed line, forming the scratch-resistant apple of the absorbent chamois material and the free ends.

19. A method of making the scratch-resistant mop of claim 10, the method comprising the steps of:

a) selecting the pole having the first and second ends;

b) gluing the rubber or rubber-coated end cap onto the first end;

c) wrapping the common end margins of the absorbent chamois material about the rubber or rubber-coated end cap, the absorbent chamois material selected from the group consisting of polyvinyl alcohols (A) which satisfy the requirements: (1) a water absorption in water at 30° C. ranging from 10 to 100 times the weight of the fibers; (2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g, and (B) which are water soluble at temperatures above approximately 93° C.;

d) securing the wrapped common end margins to the base of the rubber or rubber-coated end cap by winding the one or more scratch-resistant lines over the common end margin about the base of the rubber or rubber-coated end cap and tying the one or more scratch-resistant lines;

e) pulling the plurality of strips of absorbent chamois material tightly back over the secured common end margin and one or more tied scratch-resistant lines so that end portions of the common end margins extend past the end cap, and all the strips of absorbent chamois material are gathered at the distal end of the end cap; and f) securing the plurality of strips of absorbent chamois material with the final scratch-resistant line, forming the scratch-resistant apple of the absorbent chamois material and the free ends.

* * * * *